US006655391B2

(12) United States Patent
Sunago

(10) Patent No.: US 6,655,391 B2
(45) Date of Patent: Dec. 2, 2003

(54) COMBINATION APPLICATOR HAVING OPPOSITELY DIRECTED BRUSHES

(75) Inventor: Miyuki Sunago, Tokyo (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 09/950,627

(22) Filed: Sep. 13, 2001

(65) Prior Publication Data

US 2002/0029786 A1 Mar. 14, 2002

(30) Foreign Application Priority Data

Sep. 13, 2000 (JP) ..... 2000-278243

(51) Int. Cl.[7] ..... A45D 40/26
(52) U.S. Cl. ..... 132/218; 401/17
(58) Field of Search ..... 132/218, 139, 132/313, 314, 317, 318, 320; 15/106, 160, 114; 401/122, 129, 17, 18

(56) References Cited

U.S. PATENT DOCUMENTS

| | | | | | |
|---|---|---|---|---|---|
| 2,829,655 | A | * | 4/1958 | Bau | 132/218 |
| 3,073,320 | A | * | 1/1963 | Seaver | 401/121 |
| 3,341,884 | A | * | 9/1967 | Pryor | 401/17 |
| 3,690,777 | A | * | 9/1972 | Costa | 401/17 |
| 4,600,328 | A | * | 7/1986 | Clements | 401/129 |
| 4,886,080 | A | * | 12/1989 | Cole | 132/320 |
| 5,097,853 | A | * | 3/1992 | Nehashi | 132/320 |
| 5,620,270 | A | * | 4/1997 | Gueret | 401/126 |
| 5,762,077 | A | * | 6/1998 | Griffiths, Jr. | 132/74.5 |
| 5,794,632 | A | * | 8/1998 | Gueret | 132/317 |
| 5,881,742 | A | * | 3/1999 | Hunsberger | 132/297 |
| 5,970,990 | A | * | 10/1999 | Dunton et al. | 132/218 |
| 6,464,418 | B1 | * | 10/2002 | Visser et al. | 401/34 |

FOREIGN PATENT DOCUMENTS

| | | |
|---|---|---|
| DE | 2 037 409 | 2/1972 |
| FR | 2 155 192 | 5/1973 |
| GB | 1 315 639 | 5/1973 |
| JP | 59-64007 | 4/1984 |
| JP | 2-116312 A | 5/1990 |
| JP | 3069235 | 3/2000 |

OTHER PUBLICATIONS

Derwent Abstract, EP 99288, Jan. 25, 1984.

* cited by examiner

*Primary Examiner*—Eduardo C. Robert
*Assistant Examiner*—David Comstock
(74) *Attorney, Agent, or Firm*—Birch, Stewart, Kolasch & Birch, LLP

(57) ABSTRACT

A mascara makeup tool having a first mascara container and a second mascara container each containing mascara; a first cap element and a second cap element; and a first applicator brush and a second applicator brush. The first cap element and second cap element are joined together such that the first applicator brush and second applicator brush are aligned on a substantially straight line and face in mutually opposite directions; and the length of the bristled portion of the second applicator brush is 20 to 60% of the length of the bristled portion of the first applicator brush.

8 Claims, 1 Drawing Sheet

COMBINATION APPLICATOR HAVING OPPOSITELY DIRECTED BRUSHES

BACKGROUD OF THE INVENTION

1. Field of the Invention

The present invention relates to a mascara makeup tool.

2. Description of the Related Art

As shown in FIG. 2 (cross sectional view), a conventional mascara makeup tool has a mascara container 21 containing mascara 20, a cap element 22 for sealing the mascara container 21, and an applicator brush 23 installed on the cap element 22. Here, the applicator brush 23 is constituted of a bristled portion 24 and a shaft portion 25. A male screw 26 is formed on the mascara container 21 and a female screw 27, corresponding to the male screw 26, is formed on the cap element 22. Also, a doughnut-shaped mascara removing element 28 is established on the inner walls in the vicinity of the opening of the mascara container 21, where the mascara removing element is for wiping excess mascara from the bristled portion 24 of the applicator brush 23 (see Japanese Patent Application Laid-open No. S59-64007).

However, the size of the applicator brush in a conventional mascara makeup tool is suited for the upper lashes in the center of the eye. When applying mascara to the comparatively short and fine lower lashes or upper lashes near the outer corner of the eye, or when making the final, delicate touches, one must use the tip of the applicator brush. This requires advanced skill to get the intended effect and also requires a comparatively long amount of time.

SUMMARY OF THE INVENTION

It is an object of the present-invention to provide a mascara makeup tool with which it is possible to apply mascara easily, surely, and quickly to lashes of different thicknesses and lengths.

The present inventor discovered that mascara can be applied easily, surely, and quickly to lashes of different thicknesses and lengths by using a makeup tool having relatively large and small brushes, where two caps are joined together and can seal two mascara containers, with a normal sized applicator brush (relatively large brush) mounted on one end of the caps, and a small sized applicator brush (relatively small brush) on the other end. The inventor thereby arrived at the present invention.

Specifically, the present invention provides a mascara makeup tool comprising: a first mascara container and a second mascara container each containing mascara; a first cap element for sealing the first mascara container and a second cap element for sealing the second mascara container; and a first applicator brush mounted on the first cap element so as to be capable of being inserted in the first mascara container and a second applicator brush mounted on the second cap element so as to be capable of being inserted into the second mascara container; wherein the first cap element and second cap element are joined so that the first applicator brush and second applicator brush are aligned on a substantially straight line and face in mutually opposite directions; and the length of the bristled portion of the second applicator brush is 20 to 60% of the length of the bristled portion of the first applicator brush.

DESCRIPTION OF THE PREFERRED EMBODIMENTS

Figure 1A:
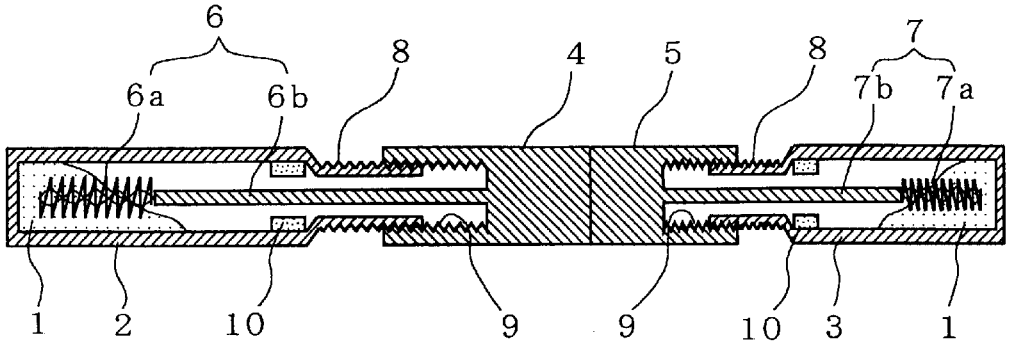
FIG. 1A is a cross sectional view of the mascara makeup tool relating to the present invention.

The present invention is explained in detail below with reference to the drawings. Moreover, identical numbers in the drawings indicate identical or equivalent elements.

Figure 1B:
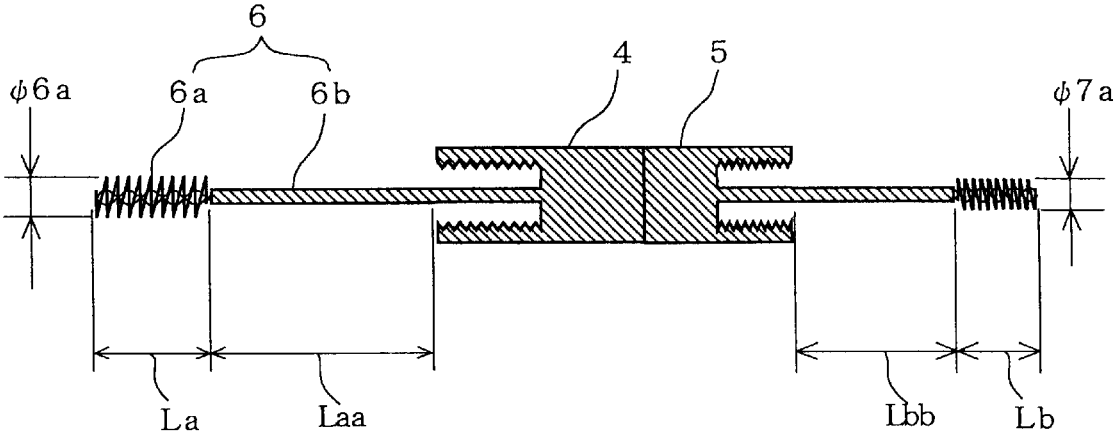
FIG. 1B is a cross sectional view of only the cap elements and applicator brushes.
Figure 2:
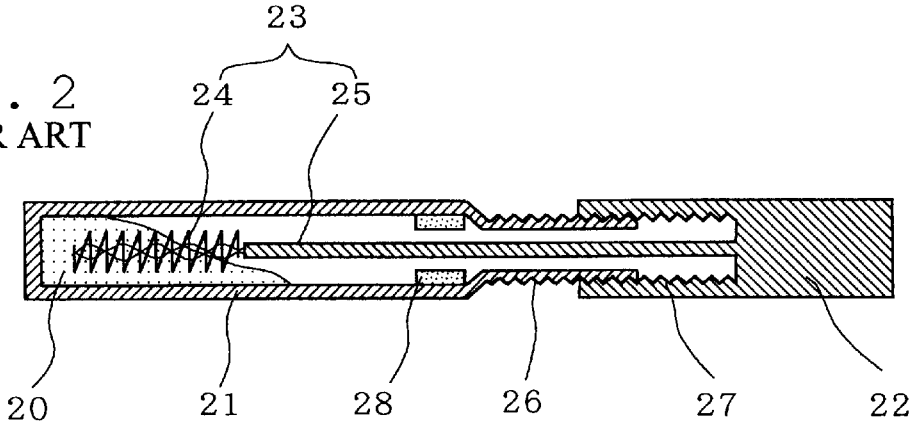
FIG. 2 PRIOR ART
FIG. 2 is a cross sectional view of a conventional mascara makeup tool.

FIG. 1A is a cross sectional view of the mascara makeup tool relating to a first mode of the present invention. FIG. 1B is a cross sectional view of the applicator brushes with the mascara containers removed from the mascara makeup tool.

This mascara makeup tool has a first mascara container 2 and a second mascara container 3 each containing mascara 1, and a first cap element 4 for sealing the first mascara container 2 and a second cap element 5 for sealing the second mascara container 3.

A first applicator brush 6 is mounted on the first cap element 4 so as to be capable of being inserted in the first mascara container 2. Meanwhile, a second applicator brush 7 is mounted on the second cap element 5 so as to be capable of being inserted into the second mascara container 3. The first applicator brush 6 and second applicator brush 7 have a bristled portion 6*a*, 7*a* and a shaft portion 6*b*, 7*b*, respectively.

A male screws 8 are formed on the first mascara container 2 and second mascara container 3, respectively. A female screws 9, corresponding to the male screws 8, are formed on the first cap element 4 and second cap element 5, respectively. Doughnut-shaped mascara removing elements 10 are established on the inner walls in the vicinity of the openings of the first mascara container 2 and second mascara container 3, where the mascara removing elements are for wiping excess mascara adhered to the bristled portion 6*a* of the first applicator brush 6 and the bristled portion 7*a* of the second applicator brush 7.

Moreover, the form of the mascara removing elements 10 is not limited to the doughnut shape and may take a variety of forms which are able to remove excess mascara adhered to the bristled portion 6*a* of the first applicator brush 6 and the bristled portion 7*a* of the second applicator brush 7.

In the present invention, the first cap element 4 and second cap element 5 are joined together so that the first applicator brush 6 and second applicator brush 7 are aligned on a substantially straight line and face in mutually opposite directions. The joined first cap element 4 and second cap element 5 function also as a holder for gripping the applicator brush 6 and 7 when using the mascara makeup tool.

Moreover, the combined length of the first cap element 4 and second cap element 5 is approximately the same as a cap on a normal mascara makeup tool.

A conventional, general-purpose mascara applicator brush can be used as the first applicator brush 6 and second applicator brush 7 used in the present invention. For example, it is possible to use a brush comprising a wire of diameter 0.5 to 0.8 mm bent in two and twisted to anchor synthetic fibers held therein. However, the length Lb of the bristled portion 7*a* of the second applicator brush 7 is 20 to 60%, and preferably 30 to 50%, of the length La of the bristled portion 6*a* of the first applicator brush 6. If less than 20%, this is too short and difficult to use; if greater than 60%, there is little difference from the applicator brush 6 and this falls outside the gist of the present invention of using different applicator brushes.

Moreover, the specific length Lb of the bristled portion 7*a* of the second applicator brush 7 is preferably 2 to 15 mm, and more preferably 3 to 9 mm, because the application operation becomes difficult when too short and the fine application operation becomes difficult when too long. On the other hand, the specific length La of the bristled portion 6*a* of the first applicator brush 6 is preferably 20 to 30 mm, and more preferably 23 to 27 mm, in order to make it easy to apply mascara to the upper lashes near the center of the eye.

In the present invention, the diameter ϕ7*a* of the bristled portion 7*a* of the second applicator brush 7 is preferably 30 to 70%, and more preferably 50 to 65%, of the diameter ϕ6*a* of the bristled portion 6*a* of the first applicator brush 6. This is because it is feared that if less than 30%, this will be too slim and manufacturing will become difficult, and if greater than 70%, the fine application operation will become difficult.

Moreover, the specific diameter ϕ7*a* of the bristled portion 7*a* of the second applicator brush 7 is preferably 1 to 5 mm, and more preferably 3 to 4 mm, because manufacturing becomes difficult if this is too slim and the user will not be able to make delicate adjustments if this is too large. On the other hand, the specific diameter ϕ6*a* of the bristled portion 6*a* of the first applicator brush 6 is preferably 5 to 8 mm, and more preferably 6 to 7.7 mm, because the brush cannot carry sufficient mascara if too small and becomes difficult to use if too large.

In the present invention, the length Lbb of the shaft 7*b* of the second applicator brush 7 is preferably shorter than the length Laa of the shaft 6*b* of the first applicator brush 6. This is because the user will not be able to make delicate adjustments if this shaft is not short.

Moreover, the specific length Lbb of the shaft 7*b* of the second applicator brush 7 is preferably 15 to 30 mm, and more preferably 18 to 25 mm, because it is difficult to use if too short and becomes difficult to use and inconvenient to carry if too long. Meanwhile, the specific length Laa of the shaft 6*b* of the first applicator brush 6 is preferably 25 to 45 mm, and more preferably 28 to 40 mm, because it is difficult to use if too short and becomes difficult to use and inconvenient to carry if too long.

Moreover, the mascara makeup tool relating to the present invention explained above is provided two applicator brushes, small and large. The user can therefore capture and apply mascara to the upper lashes near the center of the eye with the larger applicator brush, and also neatly capture and apply mascara to the relatively fine and short lower lashes and upper lashes near the outer corner of the eye with the smaller applicator brush. It also becomes possible to make the final, delicate touches easily and quickly without the necessity for considerable practice.

The mascara makeup tool relating to the present invention makes it possible to apply mascara easily, surely, and quickly to lashes of different thicknesses and lengths.

The entire disclosure of the specification, summary, claims and drawings of Japanese Patent Application No. 2000-278243 filed on Sep. 13, 2000 is hereby incorporated by reference.

What we claim is:

1. A mascara makeup tool comprising:

a first mascara container and a second mascara container each containing mascara;

a first cap element for sealing the first mascara container and a second cap element for sealing the second mascara container; and a first applicator brush mounted on the first cap element so as to be capable of being inserted in the first mascara container and a second applicator brush mounted on the second cap element so as to be capable of being inserted into the second mascara container;

wherein the first cap element and second cap element are joined together such that the first applicator brush and second applicator brush are aligned on a substantially straight line and face in mutually opposite directions; and the second applicator brush having a bristled portion length that is 20 to 60% of a bristled portion length of the first applicator brush.

2. The mascara makeup tool, according to claim 1, wherein a diameter of the bristled portion of the second applicator brush is 30 to 70% of a diameter of the bristled portion of the first applicator brush.

3. The mascara makeup tool, according to claim 1, wherein the second applicator brush has a shaft whose length is shorter than a shaft length of the first applicator brush.

4. The mascara makeup tool, according to any of claims 1 through 3, wherein the bristled portion length of the second applicator brush is 2 to 15 mm.

5. A mascara makeup tool comprising:

a first mascara container and a second mascara container each containing mascara;

a first cap element for sealing the first mascara container and a second cap element for sealing the second mascara container; and a first applicator brush mounted on the first cap element so as to be capable of being inserted in the first mascara container and a second applicator brush mounted on the second cap element so as to be capable of being inserted into the second mascara container;

wherein the first cap element and second cap element are joined together such that the first applicator brush and second applicator brush are aligned on a substantially straight line and face in mutually opposite directions; and the second applicator brush having: (i) a bristled portion length that is 20 to 60% of a bristled portion length of the first applicator brush, with the bristled portion length of the second applicator brush being from 2 to 15 mm, (ii) a bristled portion diameter that is 30 to 70% of a bristled portion diameter of the first applicator brush, with the bristled portion diameter of the second applicator brush being from 1 to 5 mm, and (iii) a shaft length that is shorter than a shaft length of the first applicator brush, with the shaft length of the second applicator brush being from 15 to 30 mm.

6. The mascara makeup tool, according to claim 5, wherein the bristled portion length of the first applicator brush is from 20 to 30 mm, the bristled portion diameter of the first applicator brush is from 5 to 8 mm, and the shaft length of the first applicator brush is from 25 to 45 mm.

7. A mascara makeup tool comprising:

a first mascara container and a second mascara container each containing mascara;

a first cap element for sealing the first mascara container and a second cap element for sealing the second mascara container; and a first applicator brush mounted on the first cap element so as to be capable of being inserted in the first mascara container and a second applicator brush mounted on the second cap element so as to be capable of being inserted into the second mascara container;

wherein the first cap element and second cap element are joined together such that the first applicator brush and second applicator brush are aligned on a substantially straight line and face in mutually opposite directions; and the second applicator brush having: (i) a bristled portion length that is 30 to 50% of a bristled portion length of the first applicator brush, with the bristled portion length of the second applicator brush being from 3 to 9 mm, (ii) a bristled portion diameter that is 50 to 65% of a bristled portion diameter of the first applicator brush, with the bristled portion diameter of the second applicator brush being from 3 to 4 mm, and (iii) a shaft length that is shorter than a shaft length of the first applicator brush, with the shaft length of the second applicator brush being from 18 to 25 mm.

8. The mascara makeup tool, according to claim 7, wherein: the bristled portion length of the first applicator brush is from 23 to 27 mm, the bristled portion diameter of the first applicator brush is from 6 to 7.7 mm, and the shaft length of the first applicator brush is from 28 to 40 mm.

* * * * *